United States Patent [19]

Capezzuto

[11] Patent Number: 4,469,464

[45] Date of Patent: Sep. 4, 1984

[54] INK PAD APPLICATOR

[75] Inventor: John P. Capezzuto, Cambridge, Mass.

[73] Assignee: Dennison Manufacturing Company, Framingham, Mass.

[21] Appl. No.: 350,772

[22] Filed: Feb. 22, 1982

[51] Int. Cl.[3] ..... B05C 17/00; B43K 8/02

[52] U.S. Cl. ..... 401/183; 401/196; 401/202; 401/207

[58] Field of Search ..... 401/183, 185, 196, 202, 401/207

[56] References Cited

U.S. PATENT DOCUMENTS

| | | | |
|---|---|---|---|
| 336,945 | 3/1886 | Redington | 401/207 |
| 973,375 | 10/1910 | Molloy | 401/183 |
| 2,870,471 | 1/1959 | Albert | 401/202 |
| 2,913,747 | 11/1959 | Hempel | 401/183 |
| 3,184,779 | 5/1965 | Lloyd | 401/202 X |
| 4,050,826 | 9/1977 | Berghahn et al. | 401/196 |

FOREIGN PATENT DOCUMENTS

| | | | |
|---|---|---|---|
| 2151741 | 5/1973 | Fed. Rep. of Germany | 401/202 |
| 887689 | 8/1943 | France | 401/202 |
| 1095428 | 6/1955 | France | 401/207 |
| 742615 | 12/1955 | United Kingdom | 401/202 |

*Primary Examiner*—Steven A. Bratlie

*Attorney, Agent, or Firm*—Barry D. Josephs; Arthur B. Moore; George E. Kersey

[57] ABSTRACT

An applicator for uniformly dispensing liquid such as ink. The applicator is composed of a flexible supply bottle with a porous plastic applicator disc attached to one end. The porous plastic applicator forms a tight seal with the ink supply bottle. The applicator disc is preferably composed of sintered porous polyethylene having an average pore size of between about 35 to 50 microns in diameter with pores occupying between about 40 to 50 percent of the applicator volume. When the bottle is squeezed, ink is forced out of the bottle through the porous applicator disc; and when the bottle is released, ink trapped within the applicator disc interior returns to the bottle preventing clogging of the applicator disc. The applicator is secured to the ink supply bottle by engagement between an annular flange at the bottle's mouth and a circumferential groove in the applicator.

7 Claims, 7 Drawing Figures

FIG. 1B
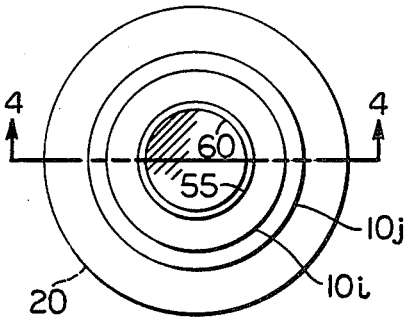
FIG. 2B
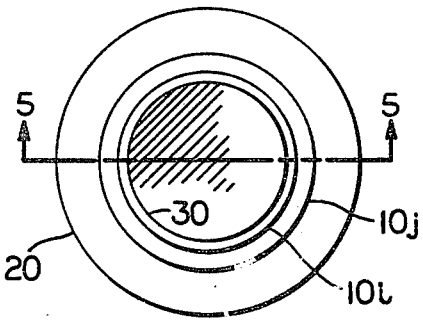
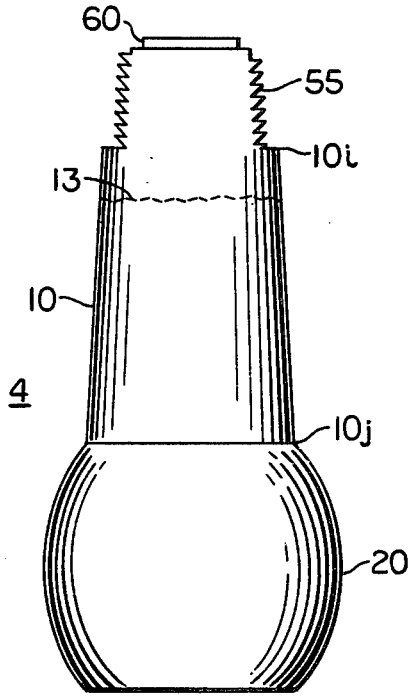
FIG. 1A
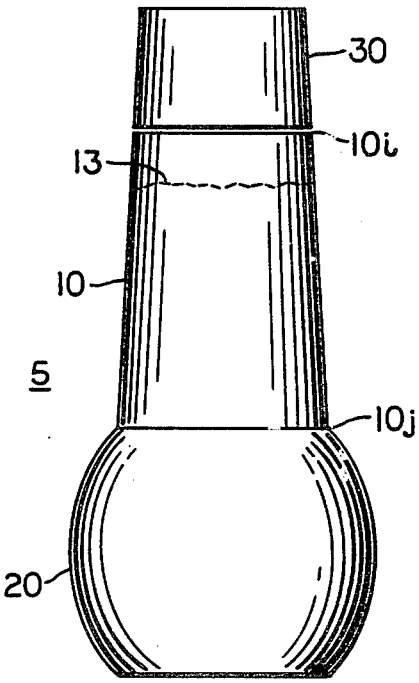
FIG. 2A

INK PAD APPLICATOR

BACKGROUND OF THE INVENTION

1. Field of the Invention

The present invention relates to a device for storing a supply of liquid such as ink and dispensing the liquid in a uniform flow.

2. Description of the Prior Art

The prior art discloses a variety of applicator devices for storing a supply of liquid such as ink and for applying the liquid to an absorbent surface, for example an ink stamp pad, in order to saturate and fill the pad. In one conventional applicator, the ink is stored in a rigid bottle and may be applied to the ink pad surface by an eyedroplet conduit attached to the bottle. The eyedroplet applicator is not very suitable for use in saturating an ink stamp pad because the process is slow and inefficient, and the applicator tends to clog over a period of time.

In another ink applicator disclosed in the prior art, a squeezable bottle is provided for storing a supply of ink and the ink is dispensed through a ball and socket roll-on type applicator secured to one end. Ball and socket applicators have the disadvantage that the ball must be fitted to the socket within a narrow tolerance. The tolerance between ball and socket must be specifically tailored to the viscosity and fluid properties of the liquid. Even if the ball is fitted properly within the socket, there is a tendency for the movement of the ball to either loosen or tighten significantly upon prolonged use of the applicator. If the movement of the ball in the socket is too loose, the applicator leaks, and the user has difficulty in applying uniform coatings of ink onto the desired surface. If the movement of the ball in the socket is too tight, the user has difficulty in squeezing ink from the bottle. Also ink has a tendency to dry on the ball's surface and within the socket, thus retarding free movement of the ball during the next application. In view of these inherent difficulties, applicators of this type are unsuitable for ink service.

Another variety of squeezable applicator bottles described in the prior art includes a squeegee composed of a porous plastic foam material, for example polystyrene foam, attached to an open end of a squeezable supply bottle. Applicators of this type are in common use as liquid shoe polish dispensers. The squeegee-type applicator is expensive to manufacture and generally durable. As the user squeezes the supply bottle, liquid saturates the squeegee. The liquid is then applied to a surface by stroking the surface with the saturated squeegee. One serious problem encountered with the squeegee-type applicator is that the liquid absorbed into the squeegee cannot be made to completely return to the squeezable supply bottle when the user releases the bottle. Since ink leaves a solid residue on drying, if ink were used as the dispensing liquid it would dry and cake quickly within the squeegee pores thus making it difficult or impossible to dispense ink properly in a later application.

Designs employing a porous plastic nib are disclosed in the prior art for use in connection with writing implements and are generally unsuitable for use in dispensing larger quantities of ink. For example, writing implements may be composed of a porous nib connected to a felt or porous plastic ink reservoir. A writing implement of this type is disclosed in patent application Ser. No. 208,604, filed Nov. 20, 1980 commonly assigned with the present application. Such writing implements are designed to permit only a tiny flow of ink from the ink reservoir to the nib during writing. Therefore, designs having a writing nib connected to a felt or porous reservoir are unsuitable for the intended service of saturating an ink stamp pad or other services where significant quantities of ink must be dispensed.

Accordingly, an object of the present invention is to provide a device permitting the quick dispensing of liquid in even coats therefrom to uniformly coat and saturate an absorbent material such as an ink stamp pad.

Another object of the invention is to provide a device for dispensing of liquid such as ink which device will provide continued service without clogging or caking by the liquid to be dispensed.

A further object is to provide a device for dispensing liquid which is easily operable, and provides prolonged trouble-free service.

SUMMARY OF THE INVENTION

In accomplishing the foregoing related objects the applicator of the invention includes a supply bottle and a porous, plastic applicator disc affixed to an open end of the bottle. The ink supply bottle includes a flexible body portion suitable for hand gripping and squeezing. The applicator is secured to the open end of the supply bottle in a liquid impervious seal.

In the preferred embodiment, the open end of the ink supply bottle includes an annular flange preferably extending inwardly. The annular flange forms an opening or a narrow passage at the open end of the bottle. The flange is typically circular, but may be of any ring-like shape, such as oblong or polygonal, to conform to the shape of the applicator disc.

The applicator disc is typically of conical or cylindrical shape, and terminates in a tapered end. The applicator disc is provided with a circumferential groove, located approximately midway along the width of the disc. The groove is bounded by a protruding surface or compression ring at lower ends of the applicator disc. The applicator disc thereby is readily insertable into the open end of the ink supply bottle to a position of engagement between the annular flange and circumferential groove. This provides a secure, liquid impervious seal between the applicator disc and the ink supply bottle without using adhesive or other sealing devices. The applicator disc is preferably composed of a sintered, porous plastic material having the proper porosity and capillary action to permit even flow of ink. A screw tight cap having a compressible liner therein contacts and covers the applicator disc in a pressure fit to prevent seepage of ink should the supply bottle inadvertently be tilted or rolled over in storage.

In use, the ink supply bottle is inverted and the body of the bottle squeezed by hand force to force ink from within the bottle through the porous core structure of the disc. As the applicator disc becomes saturated with ink, ink begins to seep from the top surface of the disc, thus providing a uniform flow of ink or other liquid. The applicator disc of the invention has particular utility in coating an ink stamp pad with ink in order to fill the pad. When the flexible body portion of the ink supply bottle is released, the bottle expands to regain its original shape, and a partial vacuum is created within the interior of the bottle. The porous structure, composition, and thickness of the applicator disc permit ink trapped within the pores of the disc, or on its surfaces, to seep back into the ink bottle when a partial vacuum is created within the bottle.

BRIEF DESCRIPTION OF THE DRAWINGS

FIG. 1A is an elevation view of an applicator in accordance with the preferred embodiment, with applicator disc attached;

FIG. 1B is a plan view of the ink applicator of FIG. 1A;

FIG. 2A is an elevation view of the ink applicator of FIG. 1, with a cap attached;

FIG. 2B is a plan view of the ink applicator illustrated in FIG. 2A;

DETAILED DESCRIPTION

Figure 3:
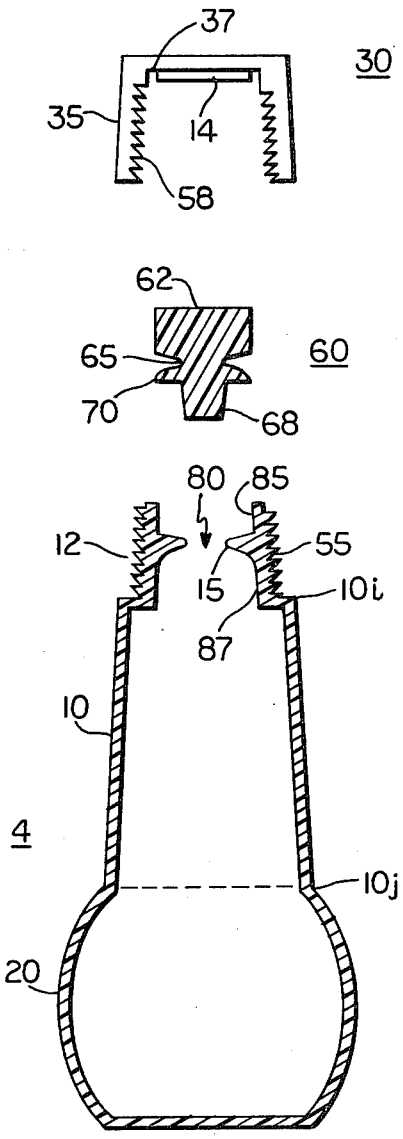
FIG. 3 is an exploded view of the ink applicator of FIG. 2A.
Figure 4:
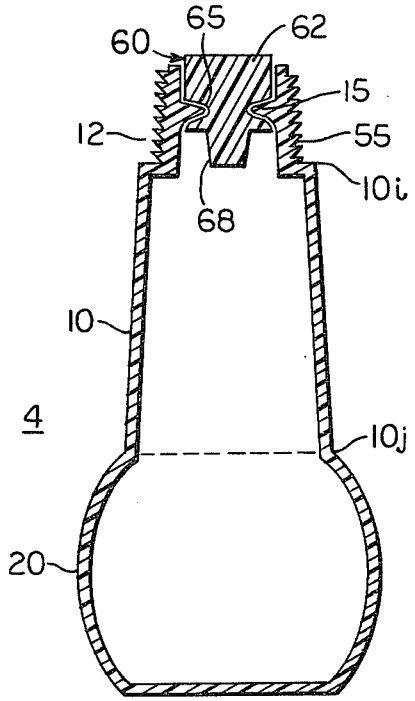
FIG. 4 is a sectional view of the ink applicator with attached applicator disc taken along sight lines 4—4 of FIG. 1B.
Figure 5:
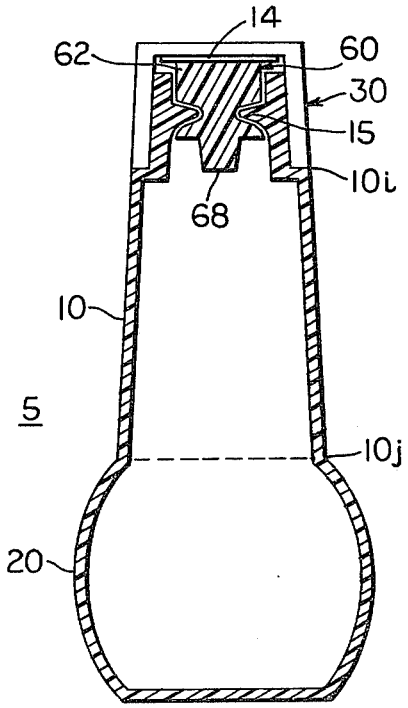
FIG. 5 is a sectional view of the ink applicator with applicator disc and cap taken along sight lines 5—5 of FIG. 2B.

A preferred embodiment of the liquid dispensing applicator of the invention is illustrated in FIGS. 1A through 5. The liquid applicator 5 of the invention, as best seen in FIGS. 1A through 3, is composed of a liquid supply bottle 4 containing an applicator disc 60 and a cap 30, which may be screwed onto supply bottle 4 to protect applicator disc 60 when the applicator 5 is not in use. Liquid applicator 5 including supply bottle 4 is particularly suitable for dispensing ink to uniformly coat and saturate an ink stamp pad.

Supply bottle 4 is composed of a resilient, thermoplastic material such as polyethylene or polypropylene, and is composed of a body portion 10 which preferably is slightly tapered terminating in bulbous portion 20, as illustrated in FIGS. 1A and 2A. Thus, edge 10*i* of body portion 10 is preferably of smaller diameter than edge 10*j*. Supply bottle 4 is typically of size which may be handheld, for example of about 2 fluid ounces, and composed of resilient plastic, such as polypropylene or polyethylene. Supply bottle 4 can be molded at low cost but yet is sufficiently resilient and durable that it does not rupture even at relatively small thicknesses. Typically when such plastic material is used, the wall thickness of body portion 10 and the bulbous portion 20 may be between about 0.035 to 0.050 inches, preferably about 0.04 inches. The supply bottle 4 may be of uniform cylindrical design; however, the design shown in FIG. 1 includes a bulbous bottom portion 20 which has been found effective. The bulbous design is easy to grip and increases the resilience of the plastic, so that after portion 20 has been squeezed and then released it more readily returns to its original shape. Also, the bulbous shape of portion 20 allows a vacuum to be created more easily within ink supply bottle 4 after the bulb portion has been squeezed and released. The bulbous design also causes ink or other liquid to be forced into applicator disc 60 as portion 20 is squeezed.

Bottle 4 contains a supply of liquid, such as stamp pad ink, filled approximately to level 13. Bottle 4 is handheld by bulbous portion 20 and tipped upside down, whereupon the user need only squeeze bulbous portion 20 in order to force a supply of ink or other liquid through applicator disc 60. Liquid squeezed from the bottle through applicator disc 60 can then be spread uniformly onto any flat surface. Dispensing applicator 5 has particular utility if filled with conventional stamp pad ink such as glycol or glycerine based ink having a viscosity between about 20 to 200 centipoise. After ink or other liquid has been dispensed, the user may then simply tilt the bottle 4 to its upright position and release bulb 20. The walls of bulb 20 then expand outwardly to their original shape, whereupon a partial vacuum is created within supply bottle 4 which permits the liquid trapped within the porous structure of applicator disc 60 to seep from disc 60 back into supply bottle 4. The user then may replace cap 30 onto supply bottle 4 until applicator disc 60 is completely capped in lock-tight arrangement, to prevent any inadvertent leaking of ink or other liquid.

The dispensing applicator 5 of the invention is assembled as shown in FIG. 3, by inserting applicator disc 60 into the open end 80 of supply bottle 4, and then simply screwing cap 30 over open end 80 thereby covering applicator disc 60 in a lock-tight arrangement. To permit easy insertion of applicator disc 60 into open end 80 of supply bottle 4 and to assure that applicator disc 60 is held securely within open end 80, disc 60 is provided with a circumferential groove 65 bounded by compression ring 70; and ink supply bottle 4 includes an annular flange 15 which is mated to compression groove 65. Thus, opening 80 is formed and bounded by flange 15 adjacent the top of ink supply bottle 4. Applicator disc 60 is secured to annular flange 15 by inserting the tapered lead end 68 of applicator disc 60 through opening 80 until compression ring 70 comes into contact with flange 15. At this time, upon application of a moderate hand pressure on applicator disc 60, compression ring 70 flexes to allow ring 70 to slide past flange 15. As compression ring 70 passes flange 15, the flange comes to rest within groove 65 to form a secure seal.

Although applicator disc 60 and opening 80 are typically circular, as shown in the figures, it should be understood that the applicator disc 60 and opening 80 may be of other shapes, such as oblong and polygonal. The above-described locking mechanism may be utilized irrespective of the shape and size of the applicator disc. The configuration of the opening 80 may simply be altered to accommodate different sizes and shapes of applicator disc 60 while still employing the locking mechanism described above.

After applicator disc has been securely fitted into open end 80 of the ink supply bottle 4, which contains a supply of ink or other fluid therein, cap 30 is placed over applicator disc 60. Cap 30 may be provided with screw threads 58 along its inside surface, to engage screw threads 55 located on the outside surface of the ink supply bottle 4 adjacent applicator disc 60, as illustrated in FIG. 3. Cap 30 is provided with a compressible liner 14, preferably composed of a polyethylene, along the inside top surface 37 of cap 30. As cap 30 is screwed onto the top end 12 of ink supply bottle 4, compressible liner 14 comes into pressure contact with the top surface 62 of applicator disc 60, thereby forming a lock-tight seal between applicator disc 60 and cap 30. This prevents ink from seeping through applicator disc 60 when the ink supply bottle 4 is inadvertently squeezed or rolled over in storage. As shown in FIG. 3, the top surface 62 of applicator disc 60 is preferably a flat surface.

Applicator disc 60 is formed of a sintered thermoplastic material having a porous structure. Contemporary methods may be used to sinter or fuse individual polymeric thermoplastic particles such as polyolefins, particularly polyethylene and polypropylene to form the porous structure of the applicator 60. Illustrative methods are described in U.S. Pat. Nos. 3,628,876 and 3,051,993. Applicator disc 60 is not limited to any particular diameter, but if used in connection with the above-described handheld embodiment, the diameter may be typically between about 0.700 and 0.800 inches. Preferably, applicator disc 60 is formed of sintered, porous polyethylene material having an average pore size between about 35 and 50 microns in diameter, where the pores occupy advantageously between about 40 to 50 percent of the total volume of the applicator disc. The density of the sintered, porous polyethylene material is approximately between about 0.450 to 0.60 grams/cm$^3$, and the thickness of disc 60 is advantageously greater than about 0.5 cm., advantageously between 0.5 and 1.5 cm.

Although the invention has been described with respect to a specific embodiment it should be appreciated that the invention is not intended to be limited to the foregoing description, but rather the invention is to be defined by the claims and equivalents thereof.

I claim:

1. A device for dispensing liquid ink for use in coating an ink stamp pad in order to fill the pad, comprising a container for the liquid ink including a flexible body portion and an open end, liquid ink in said container, said liquid ink having a viscosity between about 20 to 200 centipoise, a porous plastic applicator disc, substantially cylindrical, secured to said container adjacent the open end in a liquid impervious seal, said porous plastic applicator disc formed of sintered polyolefin thermoplastic material having a thickness of between about 0.5 and 1.5 centimeters and having an exposed portion being a substantially flat surface for contact with an ink pad, said porous, plastic applicator having an average pore size of less than about 50 microns, and the pores occupying less than about 50 percent of the applicator by volume, said applicator secured to the open end of said container by engagement between an annular flange at an inner surface of the open end of said container and a circumferential groove in said applicator, and wherein said applicator includes a flexible portion adjacent said circumferential groove to permit the insertion of said applicator into engagement between the annular flange and circumferential groove, wherein a squeezing of the flexible body portion of said container induces an expulsion of liquid ink through said porous plastic applicator and the release of said container allows the return of the flexible body portion substantially to its original shape and induces a partial vacuum therein which facilitates return of ink from the applicator to the container.

2. A dispensing device as defined in claim 1 wherein the flexible body portion of said container has a bulbous shape.

3. A dispensing device as defined in claim 1 wherein the polyolefin thermoplastic material is selected from the group consisting of polyethylene and polypropylene.

4. A dispensing device as defined in claim 3 wherein the flexible body portion of said container has a wall thickness between about 0.035 inch and 0.050 inch.

5. A dispensing device as defined in claim 1 wherein the porous plastic applicator is comprised of sintered porous polyethylene.

6. A dispensing device as defined in claim 5 wherein the sintered porous polyethylene applicator has an average pore diameter between about 35 and 50 microns, and the pores occupy between about 40 and 50 percent of the applicator by volume.

7. A dispensing device as defined in claim 5 wherein the sintered porous polyethylene has a density of between about 0.45 and 0.60 grams/cm.$^3$.

* * * * *